US005155927A

United States Patent [19]

Bates et al.

[11] Patent Number: 5,155,927

[45] Date of Patent: Oct. 20, 1992

[54] SHOE COMPRISING LIQUID CUSHIONING ELEMENT

[75] Inventors: Barry Bates, Eugene, Oreg.; Al Gross, Aspen, Colo.

[73] Assignee: ASICS Corporation, Nakamachi, Japan

[21] Appl. No.: 657,723

[22] Filed: Feb. 20, 1991

[51] Int. Cl.[5] ..... A43B 13/18.

[52] U.S. Cl. ..... 36/28; 36/71; 36/114

[58] Field of Search ..... 36/28, 29, 31, 71, 114, 36/30 R

[56] References Cited

U.S. PATENT DOCUMENTS

| | | | |
|---|---|---|---|
| D. 297,381 | 8/1988 | Sugiyama | D2/314 |
| D. 297,980 | 10/1988 | Sugiyama | D2/314 |
| D. 300,084 | 3/1989 | Ito et al. | D2/318 |
| D. 300,085 | 3/1989 | Ito et al. | D2/318 |
| D. 311,989 | 11/1990 | Parker et al. | D2/319 |
| 508,034 | 11/1893 | Moore . | |
| 586,155 | 7/1897 | Bascom . | |
| 850,327 | 4/1907 | Tauber . | |
| 900,867 | 10/1908 | Miller . | |
| 1,069,001 | 7/1913 | Guy . | |
| 1,517,171 | 3/1928 | Rosenwasser . | |
| 1,597,823 | 8/1926 | Randolph . | |
| 1,605,985 | 11/1926 | Rasmussen . | |
| 2,080,499 | 5/1937 | Nathansohn | 36/29 |
| 2,177,116 | 10/1939 | Persichino | 36/71 |
| 2,532,742 | 12/1950 | Stoiner | 36/35 |
| 2,600,239 | 6/1952 | Gilbert | 36/71 |
| 2,605,560 | 8/1952 | Gouabault | 36/29 |
| 3,608,215 | 9/1971 | Fukuoka | 36/29 |
| 3,724,106 | 4/1973 | Magidson | 36/44 |
| 3,765,422 | 10/1973 | Smith | 128/594 |
| 3,871,117 | 3/1975 | Richmond et al. | 36/43 |
| 4,008,530 | 2/1977 | Gager | 36/28 |
| 4,020,572 | 5/1977 | Chiaramonte, Jr. | 36/137 |
| 4,100,686 | 7/1978 | Sgarlato et al. | 36/29 |
| 4,115,934 | 9/1978 | Hall | 36/29 X |
| 4,128,861 | 12/1978 | Pelengaris | 362/103 |
| 4,130,951 | 12/1978 | Powell | 36/137 |
| 4,211,236 | 7/1980 | Krinsky | 128/594 |
| 4,219,945 | 9/1980 | Rudy | 36/29 |
| 4,223,457 | 9/1980 | Borgeas | 36/35 |

(List continued on next page.)

FOREIGN PATENT DOCUMENTS

| | | |
|---|---|---|
| 0298449 | 1/1989 | European Pat. Off. . |
| 352216 | 4/1922 | Fed. Rep. of Germany . |
| 2303384 | 1/1973 | Fed. Rep. of Germany . |
| 2460034 | 12/1974 | Fed. Rep. of Germany . |
| 2800359 | 1/1978 | Fed. Rep. of Germany . |
| 2050145 | 1/1981 | United Kingdom . |

*Primary Examiner*—Paul T. Sewell
*Assistant Examiner*—Beth Anne Cicconi
*Attorney, Agent, or Firm*—Weingram & Zall

[57] ABSTRACT

A shoe comprising a sole portion having peripheral edges and at least one cushioning element comprising a chamber having flexible walls filled with a liquid composition, wherein the chamber includes a plurality of partitions for directing flow of liquid from one portion of the chamber to another portion of the chamber. Preferably, at least one partition is a gating means responsive to a differential in liquid pressure for enabling the flow of liquid to the chamber portion of lower liquid pressure. The cushioning element overlays the sole portion. A portion of the cushioning element extends to a peripheral edge to provide cushioning support to a foot of a wearer at the peripheral edge. Preferably the extending portion of the element has substantially transparent walls, whereby the liquid composition can be viewed. Preferably, the liquid composition comprises an amount of a gel having a gel density and an amount of particulate having a particulate density, wherein the particulate density is less than the gel density. Preferably the cushioning element has a flexure joint along a portion of the element, which is a partition for directing flow of liquid from one portion of the chamber to another portion of the chamber.

24 Claims, 8 Drawing Sheets

U.S. PATENT DOCUMENTS

| | | | |
|---|---|---|---|
| 4,252,910 | 2/1981 | Schaefer | 36/71 X |
| 4,255,202 | 3/1981 | Swan, Jr. | 106/122 |
| 4,297,797 | 11/1981 | Meyers | 36/44 |
| 4,309,832 | 1/1982 | Hunt | 36/32 |
| 4,319,412 | 3/1982 | Muller | 36/29 |
| 4,322,892 | 4/1982 | Inohara | 36/29 |
| 4,342,157 | 8/1982 | Gilbert | 36/29 |
| 4,358,902 | 11/1982 | Cole et al. | 36/28 |
| 4,364,189 | 12/1982 | Bates | 36/31 |
| 4,391,048 | 7/1983 | Lutz | 36/28 |
| 4,445,283 | 5/1984 | Meyers | 36/29 |
| 4,446,634 | 5/1984 | Johnson et al. | 36/29 |
| 4,458,430 | 7/1984 | Peterson | 36/28 |
| 4,471,538 | 9/1984 | Pomeranz et al. | 36/28 |
| 4,472,890 | 9/1984 | Gilbert | 36/35 B |
| 4,506,461 | 3/1985 | Inohara | 36/29 |
| 4,523,393 | 6/1985 | Inohara | 36/29 |
| 4,535,553 | 8/1985 | Derderian et al. | 36/28 |
| 4,567,677 | 2/1986 | Zona | 36/43 |
| 4,577,417 | 3/1986 | Cole | 36/29 |
| 4,610,099 | 9/1986 | Signori | 36/3 B |
| 4,744,157 | 5/1988 | Dubner | 36/71 |
| 4,763,426 | 8/1988 | Polus et al. | 36/29 |
| 4,768,295 | 9/1988 | Ito | 36/28 |
| 4,802,289 | 2/1989 | Guldager | 36/43 |
| 4,815,221 | 3/1989 | Diaz | 36/27 |
| 4,817,304 | 4/1989 | Parker et al. | 36/114 |
| 4,833,795 | 5/1989 | Diaz | 36/29 |
| 4,843,735 | 7/1989 | Nakanishi | 36/28 |
| 4,843,741 | 7/1989 | Yung-Mao | 36/114 |
| 4,856,208 | 8/1989 | Zaccaro | 36/29 |
| 4,887,367 | 12/1989 | Mackness et al. | 36/28 |
| 4,894,932 | 1/1990 | Harada et al. | 36/29 X |
| 4,918,841 | 4/1990 | Turner et al. | 36/114 |
| 4,931,773 | 6/1990 | Rosen | 36/43 X |
| 4,934,072 | 6/1990 | Fredericksen | 36/29 |
| 4,970,807 | 11/1990 | Anderie et al. | 36/28 |
| 4,972,611 | 11/1990 | Swartz et al. | 36/28 |
| 4,974,345 | 12/1990 | Yung-Mao | 36/28 |
| 4,999,931 | 3/1991 | Vermeulen | 36/30 R X |
| 5,067,255 | 11/1991 | Hutcheson | 36/28 X |
| 5,097,607 | 3/1992 | Fredericksen | 36/29 |

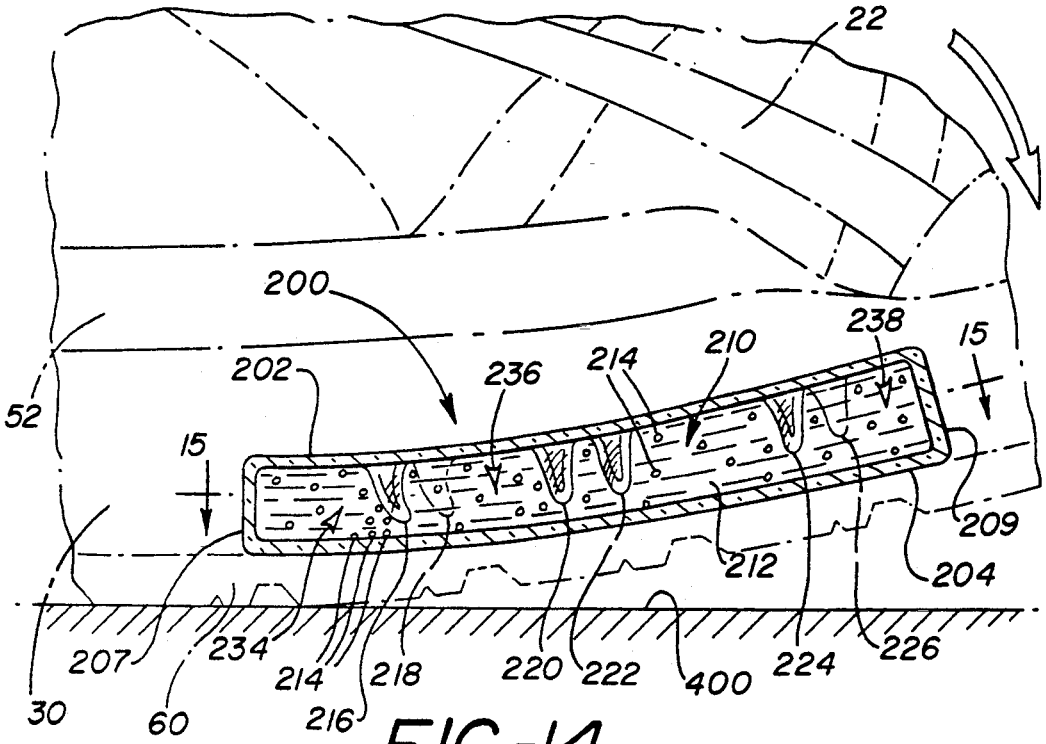
FIG-14
FIG-15
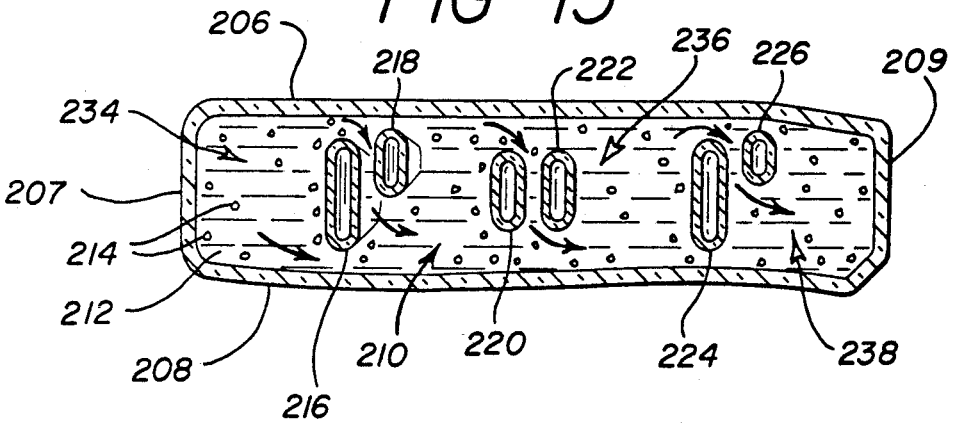

SHOE COMPRISING LIQUID CUSHIONING ELEMENT

BACKGROUND OF THE INVENTION

1. Field of The Invention

The present invention relates to sports or athletic shoes, and in particular, to an athletic shoe constructed to minimize impact shock and to maximize lateral stability.

2. Prior Art

The modern shoe, particularly an athletic shoe, is a combination of many elements which have specific functions, all of which must work together for the support and protection of the foot. The design of an athletic shoe has become a highly refined science. Athletic shoes today are varied in both design and purpose. Tennis shoes, racquetball shoes, basketball shoes, running shoes, baseball shoes, football shoes, weightlifting shoes, walking shoes, wrestling shoes, etc., are all designed to be used in very specific, and very different, ways. They are also designed to provide a unique and specific combination of traction, support, and protection to enhance performance. Not only are shoes designed for specific sports, they are also designed to meet the specific characteristics of the user. For example, shoes are designed differently for heavier persons than for lighter persons; differently for wide feet than for narrow feet; differently for high arches than for low arches, etc. Some shoes are designed to correct physical problems, such as over-pronation, while others include devices, such as ankle supports, to prevent physical problems from developing. It is therefore important to be able to adjust the characteristics of the various functional components of the shoe to accommodate these factors.

Generally, a shoe is divided into two parts, an upper and a sole. The upper is designed to snugly and comfortably enclose the foot. The sole is designed to withstand many miles of running. It must have an extremely durable bottom surface for contact with the ground. However, since such contact may be made with considerable force, protection of the foot and leg demands that the sole also perform a shock-absorbing function. It therefore typically includes a resilient, energy-absorbent material as a midsole in addition to the durable lower surface. This is particularly true for training or jogging shoes designed to be used over long distances and over a long period of time.

Extensive clinical evaluation of foot and knee injuries sustained by, for example, runners and joggers, suggests that the most important factors associated with such injuries are shock absorption on impact and lateral foot stability. Based on injury data, these two factors appear to be of about equal importance. Therefore, both factors should be carefully considered in any improvements in athletic shoes.

For most runners, initial foot impact occurs in the heel region. Therefore, the heel strike cushioning material, which is contained principally in the midsole of a running shoe must have a firmness which provides for proper impact cushioning for a person of about average weight. When the runner is heavy, the heel cushioning material may "bottom out" before heel impact is completely absorbed, and shock-related injuries can result. On the other hand, if the cushioning material is too soft, poor lateral foot stability may result in injuries. As a general rule, athletic shoes, for example running shoes, which have a relatively firm midsole, particular in the heel region, provide the best lateral stability.

Most sports include some running, though many sports place additional demands upon the shoe which are performance and/or injury related. Jump-land activities such as basketball, volleyball and aerobics typically produce forefoot impact forces due to initial forefoot contact followed shortly thereafter by greater rearfoot impact forces. These forces, either singularly, but more often cumulatively, can result in various lower extremity injuries. These activities also often incorporate mild to excessive side-to-side motions that require a stable foot platform, i.e., a stable shoe, for successful and injury free performance. These requirements are somewhat functionally similar to those of running but produce greater demands upon both the shoe and the lower extremities.

Shock to the foot, ankle, and leg maybe considered herein to be substantially vertically directed, and is directly proportional to the rate of vertical deceleration which the foot experiences during a footfall as well as a function the knee angle/action of the knee. In running, sequential impacting of first the lateral heel region in a foot, and thereafter the forefoot region, results in what might be thought of as a dual-peak shock-transmission situation. In other words, vertical foot deceleration tends to maximize in concurrence with these two events. Accordingly, shock absorption and reduction is directly attainable by minimizing the peaks of such peak deceleration by the use of a combination of heel strike, medial motion control, and forefoot cushioning elements. In landing from a jump the sequence occurs in reverse order.

There are many limiting factors in the design of a cushioned midsole for protection against foot and knee injuries, among them being the range of suitable cushioning materials. Current commercial cushioned midsoles comprise elastomeric foam, such as ethylene vinyl acetate (EVA) foam, within a narrow mid-range of hardness, or an elastomeric foam within which a gas-filled membrane is encapsulated. The use of elastomeric foam material by itself is limited to foams of relatively higher density and hardness, because low density and hardness foams are too soft and bottom out too quickly, i.e., collapse to a point where they no longer functions as a shock absorber under relatively low force, and also because low hardness foams provide very little lateral stability. Hence, prior art commercial midsoles have generally been limited to higher density, relatively hard foams, a compromise between cushioning and stability. The use of a softer foam provides additional cushioning at a sacrifice to lateral stability. Conversely, the use of a harder foam enhances lateral stability at a sacrifice to cushioning.

The use of a cushioning system comprised of a membrane partitioned into a plurality of chambers which are filled with a gas, which in turn are incorporated into a foam midsole, improves the cushioning capability of the midsole over that of conventional EVA foam because it does not bottom out as rapidly; however, problems exist with respect to such cushioning systems, e.g. leakage, etc.

Additionally, gel filled cushioning elements are well known in the art. For example, U.S. Pat. No. 4,768,295, to Ito, describes gel cushioning members having a plurality of chambers mounted in the recesses of sole plates. When the cushioning member is put in the recess formed in the sole plate, air chambers are formed between the filled chambers and the bottom of the recess. The air in the air chambers is compressed as the sole plate and the cushioning members are deformed by shock upon landing. The compressed air functions as a repulsion force when kicking. See also U.S. Pat. Nos. 300,084 and 300,085 to Ito et al. and U.S. Pat. No. 297,381 to Sugiyama. Shoes containing such gel packs are sold by ASICS Tiger Corporation, Fountain Valley, Calif.

Additional prior art references relevant to this invention are:

U.S. Pat. No. 297,980, to Sugiyama, describes a cushioning for a shoe midsole comprised essentially of one cell having partition walls therein.

U.S. Pat. No. 3,765,422, to Smith, relates to a fluid cushion podiatric insole in the form of a flat envelope in the outline of the wearer's foot and containing a semi-liquid/solid particulate material as a flowing cushioning medium. The insole is provided with transverse dividers (ribs) which divide the insole into front and rear chambers, and longitudinal dividers which serve as flow-directing wall formations.

U.S. Pat. No. 4,309,832, to Hunt, describes hinge joints in the sole of a shoe.

U.S. Pat. Nos. 4,342,157 and 4,472,890, to Gilbert, describe the use of liquid-filled shock absorbing cushions in the heel portion and forefoot portion of a shoe. Typical liquids include water, glycerine, and mineral oil.

U.S. Pat. No. 4,506,461; 4,523,393; and 4,322,892, to Inohara, describes a sports shoe sole wherein an interlayer body is provided at the heel portion with an air inclusion means such as grooves and apertures that open at least to one side of the interlayer body. The air inclusion portions open externally at each of the sides of the shoe.

U.S. Pat. No. 4,535,553, to Derderian et al., discloses a shock-absorbing sole member comprised of an insert member and elastomeric foam encasing the insert member. The insert member is formed of resilient plastic material and includes a plurality of transversely and longitudinally spaced discreet shock-absorbing projections.

U.S. Pat. No. 4,567,677, to Zona, relates to a water and air filled shoe insole having flow restrictions so as to restrict the flow of water and air from the metatarsal area and heel area and vice versa. The flow restrictions are said to provide a massaging action for the foot of the user.

U.S Pat. No. 4,610,099, to Sionori, describes a shock-absorbing shoe sole which provides adjustably inflated pneumatic support at the rear half of the sole by an inflatable bladder therein. A removable in-sole panel provides access for repair and/or replacement of the bladder. The bladder may have the upper and lower panel locally bonded or tufted at longitudinally and laterally spaced points to avoid the tendency to balloon when pressurized.

U.S. Pat. No. 4,763,426, to Polus et al., describes a sports shoe with a sole which has air chambers which accept air at positive pressure and a foot operated pneumatic inflating device connected thereto.

U.S. Pat. No. 4,815,221, to Diaz, describes a shoe having an energy control system for shock absorption and for propulsion of the wearer. The energy control system includes a spring system and an overlying energy absorbing member located in a cavity in the midsole.

U.S. Pat. No. 4,817,304, to Parker et al., describes a sole member which includes a sealed inner member of a flexible material which is inflated with a gaseous medium to form a compliant and resilient insert An elastomeric yieldable outer member encapsulates the insert about preselected portions of the insert. On the sides is a gap, i.e., opening, which permits the insert to expand into the gap during foot impact. The shoe may be designed such that the sides of the insert are at least flush with and preferably extend beyond the sides of the shoe (see FIG. 4). Additional gaps may be provided in the forefoot area.

U.S. Pat. No. 4,833,795, to Diaz, describes a shoe having a pivot surface located in the ball portion of the forefoot region to facilitate pivoting as the foot contacts the ground. The pivot surface defines a cushioning air pocket between the outsole and the midsole.

U.S. Pat. No. 4,856,208, to Zaccaro, describes a shoe sole which includes two inflatable tubes that extend along the sides of the body portion of the shoe or a single inflatable tube that extends around the periphery of the body portion so as to define an elongated recess that exposes the bottom surface of the body portion, the fluid in the inflatable tubes moving therewithin when more load is applied on one side of the shoe defining use than the other.

U.S. Pat. No. 4,887,367, to Mackness et al., describes the use of resilient spherical bodies within recesses in the front portion and/or the heel portion of the sole of a shoe. The hardness of the resilient bodies can be adjusted to enhance the elasticity of the soles of the shoe by virtue of the fact that the spherical bodies can be inflated and deflated or can be replaced.

European Patent Application, Publication No. 0 298 449 to Litchfield, describes the midsole of a shoe having an elastomeric material which has a number of spaced apart horizontal tubes extending the width of the midsole which are encapsulated in the elastomeric material. The tubes are hollow and lay side-by-side in a direction either perpendicular to the longitudinal axis of the shoe, parallel to the axis, or in any other direction functional for foot and shoe mechanics. The tubes are preferably encapsulated by the polyurethane material including encapsulation of the end of the tubes to prevent easy collapse thereof.

Patents which illustrate visible cushion means include, for example, Yunq-Mao (U.S. Pat. Nos. 4,843,741 and 4,974,345 and Swartz et al. (U.S. Pat. No. 4,972,611).

OBJECTS AND SUMMARY OF THE INVENTION

It is an object of this invention to provide novel cushioning elements for an athletic shoe.

It is a further object of this invention to provide a shoe having gel cushioning elements which provide support at the peripheral edges of the shoe and which cushioning elements can be viewed from the exterior of the shoe.

It is a further object of this invention to provide a shoe having gel cushioning elements therein which are transparent, wherein the coaction of the gel composition with the structure of the cushioning element can be viewed from the exterior of the shoe.

It is still a further object of this invention to provide an athletic shoe which includes a uniquely designed self-correcting or self-modulating gel cushioning system.

The foregoing objects of this invention are achieved by a shoe having a sole portion with peripheral edges and a cushioning element comprising a chamber having flexible walls filled with a liquid composition. The cushioning element overlies the sole portion and a portion of the cushioning element extends to a peripheral edge of the shoe to provide cushioning support to the foot of a wearer at the peripheral edge and to permit viewing of the cushioning element from the exterior of the shoe. Preferably, the portion of the cushioning element that can be viewed has substantially transparent walls, wherein the coaction of the liquid composition with the structure of the element can be viewed therethrough.

This invention is further directed to a shoe comprising a sole portion having peripheral edges, a cushioning element comprising a chamber having flexible walls filled with a liquid composition, preferably a gel composition. The liquid composition preferably comprises an amount of a gel having a gel density and an amount of particulate having a particulate density, wherein the particulate density is less than the gel density to provide a gel composition having an overall lower density than gel alone. The cushioning element overlies the sole portion, a portion of the element extending to a peripheral edge to provide cushioning support to the foot of a wearer, the extending portion of the element having substantially transparent walls, whereby the liquid composition can be viewed from the exterior of the shoe through the substantially transparent walls.

A preferred cushioning element is a heel strike cushioning element comprising a chamber having flexible walls filled with a gel composition, wherein the chamber includes a plurality of partitions for directing flow from one portion of the element to another portion of the element, wherein at least one partition is a gating means responsive to a differential in liquid pressure for enabling the flow of liquid to the portion of the element of lower liquid pressure. Preferably, the heel strike cushioning element has a flexure joint along a portion of the element, which is a partition that allows for the flexure of the element, assists in directing the flow of liquid from one portion of the element to another portion of the element and provides structural support for the cushioning element.

Still another aspect of this invention is directed to a cushioning element for a shoe sole comprising a chamber having flexible walls filled with a liquid composition, wherein the chamber includes a plurality of partitions for directing flow from one portion of the chamber to another, wherein at least one partition is a gating means responsive to a differential in liquid pressure for enabling the flow of liquid to the chamber portion of lower liquid pressure.

Another preferred cushioning element is a forefoot cushioning element for a shoe sole comprising a chamber having flexible substantially transparent walls filled with a liquid composition, wherein the chamber includes a plurality of partitions for directing flow from one portion of the chamber to another portion of the chamber, wherein the liquid composition comprises an amount of a gel having a gel density and an amount of particulate having a particulate density, wherein the particulate density is less than the gel density. Preferably the forefoot cushioning element has a flexure joint along a portion of the element which is a partition for directing flow of liquid from one portion of the chamber to another portion of the chamber.

Still another aspect of this invention is directed to a heel strike cushioning element for a shoe sole comprising a chamber having flexible substantially transparent walls filled with a liquid composition, wherein the chamber includes a plurality of partitions for directing flow from one portion of the chamber to another portion of the chamber, wherein at least one partition is a gating means responsive to a differential in liquid pressure for enabling the flow of liquid t the chamber portion of lower liquid pressure, wherein the liquid composition can be viewed through the substantially transparent walls, wherein the liquid composition comprises an amount of a gel having a gel density and an amount of particulate having a particulate density, wherein the particulate density is less than the gel density, wherein the cushioning element has a flexure joint along a portion of the element which is a partition for directing flow of liquid from one portion of the chamber to another portion of the chamber.

The foregoing and other objects, features and advantages of this invention will be apparent from the following description of the preferred embodiments of the invention as illustrated in the accompanying drawings.

BRIEF DESCRIPTION OF THE DRAWINGS

The following is a brief description of each of the figures herein:

FIG. 14 is a view similar to FIG. 12 showing initial compression at the proximal end of the medial motion control cushioning element;

FIG. 15 is a top cross-sectional view of the medial motion control cushioning element taken along line 15—15 of FIG. 14;

DETAILED DESCRIPTION OF THE INVENTION

Figure 1:
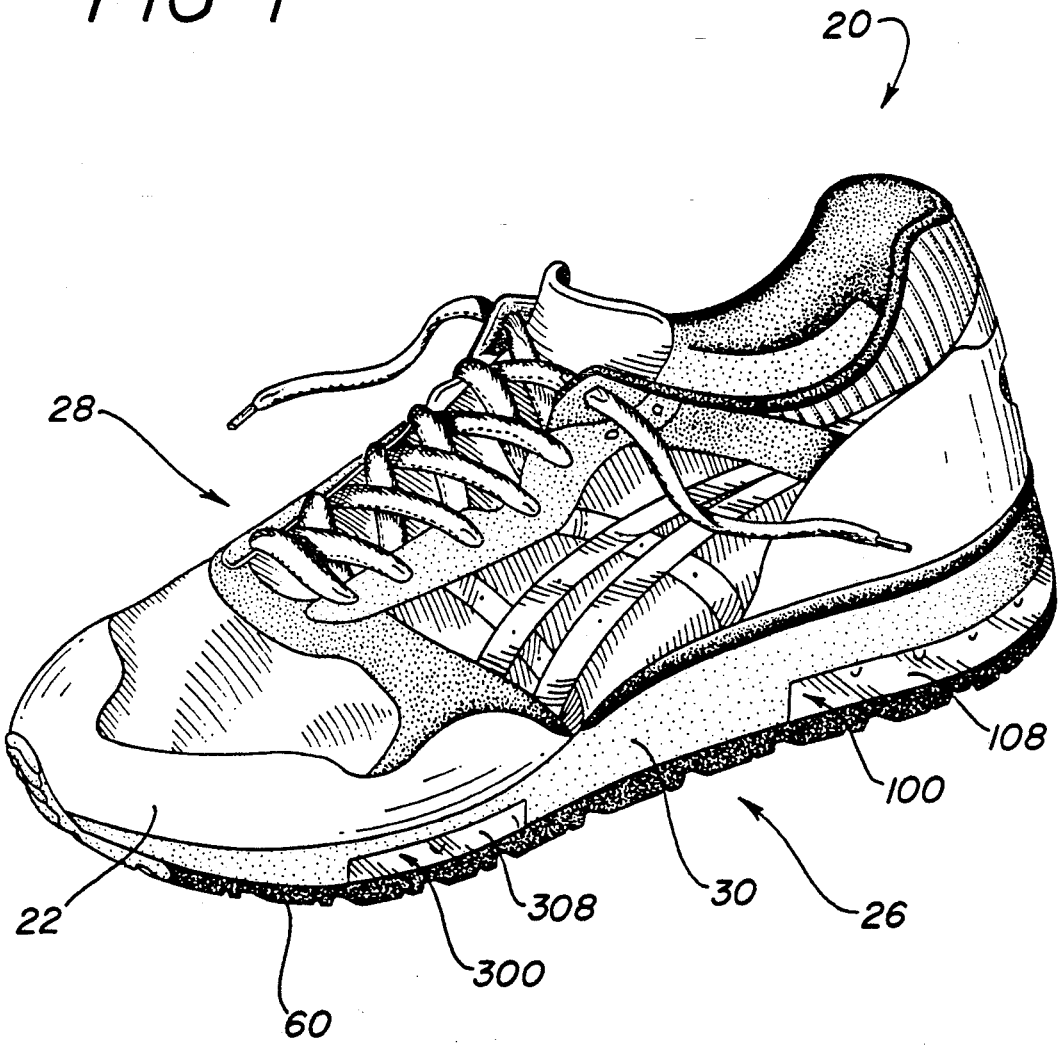
FIG. 1 is a perspective view of an athletic shoe upper and the visible gel cushioning elements of this invention.

Referring to the drawings, wherein like numerals indicate like elements, an article of footwear, such as an athletic shoe, sports shoe, or running shoe, is depicted in accordance with the present invention. Generally, the shoe comprises a sole structure or member and an upper attached thereto. The upper can be of any conventional design, while the sole structure incorporates the novel features of the present invention. The sole structure includes a force absorbing midsole and a flexible, wear resistant outsole. Of course, where appropriate, the midsole and outsole portions can be formed as a single integral unit. The midsole includes at least one cushioning element of this invention.

Referring to FIG. 1, an athletic shoe, shown generally at 20, incorporates the cushioning elements of this invention. As used herein, the "lateral edge" refers to the outside peripheral edge of the shoe and the "medial edge" refers to the inside edge of the shoe. Further, as used herein, reference to the "distal end" refers to that end of the shoe near the toes, and reference to the "proximal end" refers to that end near the heel of the shoe. All components shown in the drawings are for a left shoe, the components for a right shoe being mirror images thereof. Further, it will also be noted that the various cushioning elements of this invention may be repositioned and/or used in various combinations, depending on the various activities for which the shoe is designed and/or targeted costs/selling prices.

Figure 2:
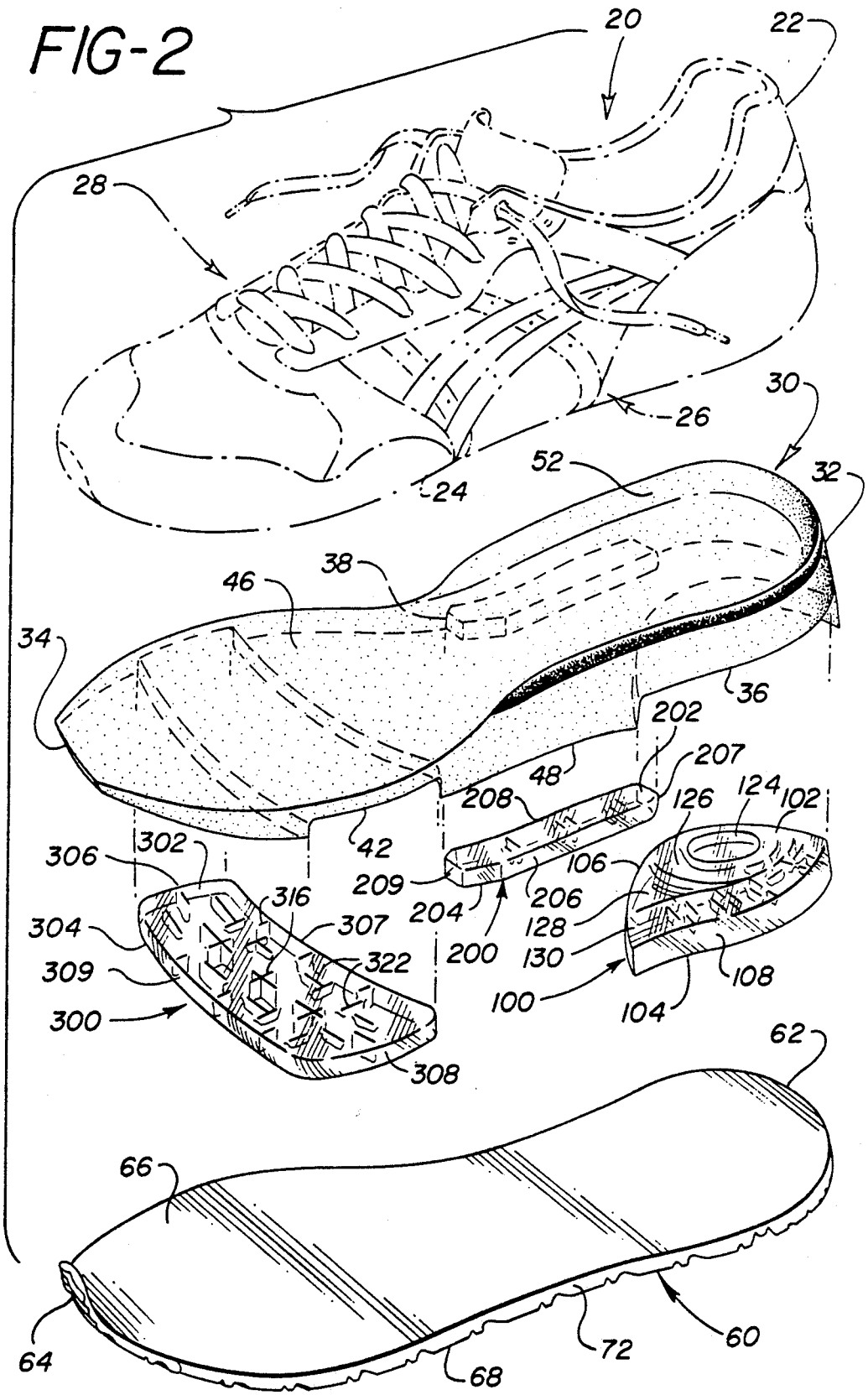
FIG. 2 is an exploded perspective view of the shoe of FIG. 1 depicting the various elements of this invention.
Figure 3:
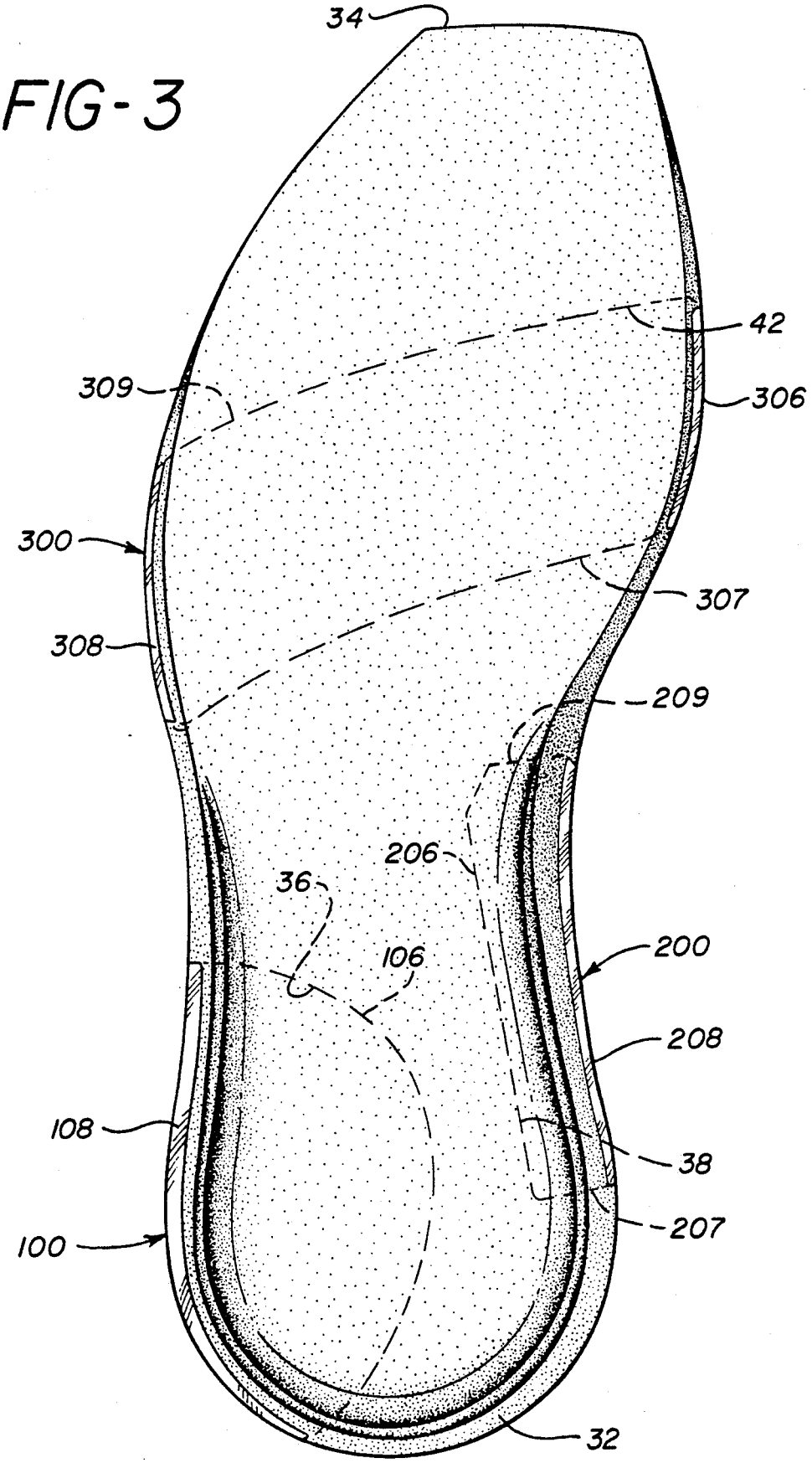
FIG. 3 is a top plan view of the midsole of the shoe of this invention with the gel cushioning elements positioned in their respective cavities.

As may be seen in FIG. 1, shoe 20 has an upper 22 attached to midsole 30. Readily visible at the lateral edge 26 of the shoe 20 are two of the cushioning elements of this invention: heel strike cushioning element 100 and forefoot cushioning element 300. Referring to FIGS. 2 and 3, the third cushioning element of the present invention, medial motion cushioning element 200, is positioned at the medial side 28 of the shoe 20.

Figure 4:
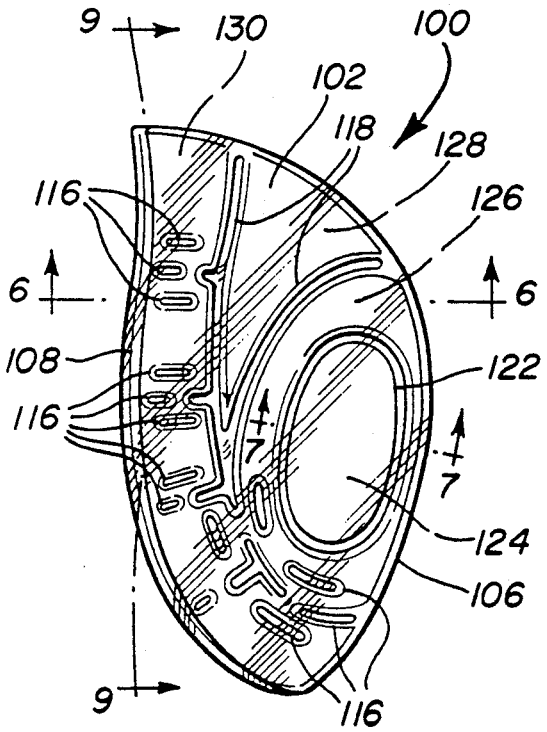
FIG. 4 is a top plan view of the heel strike cushioning element of this invention.
Figure 5:
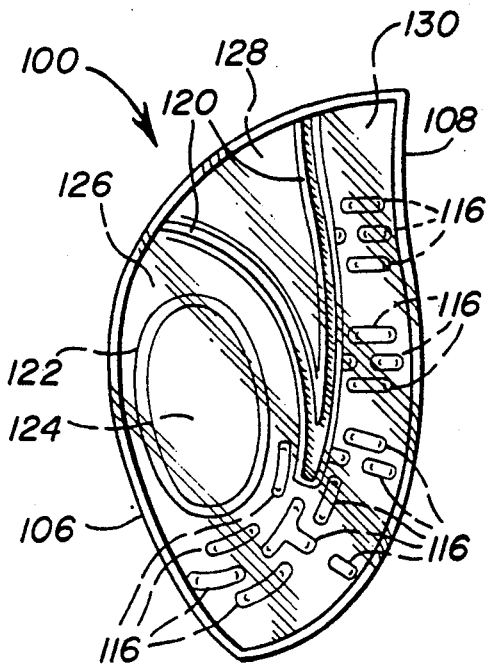
FIG. 5 is a bottom plan view of the heel strike cushioning element of this invention.
Figure 10:
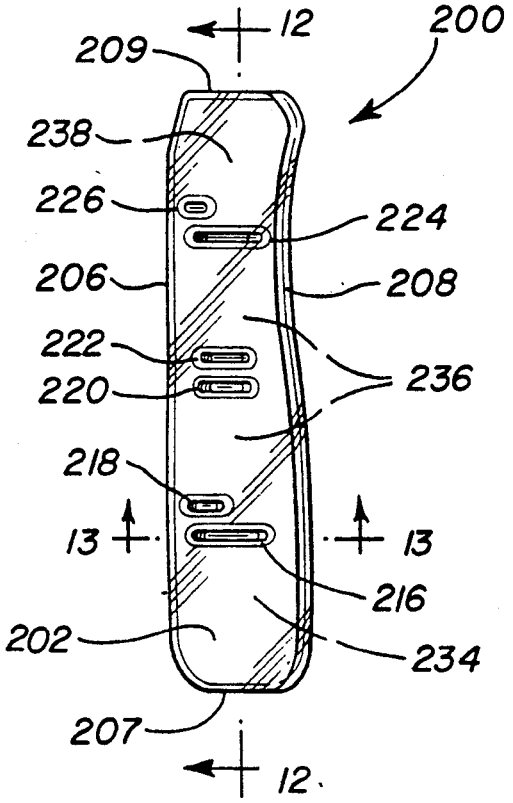
FIG. 10 is a top plan view of the medial motion control cushioning element of this invention.
Figure 11:
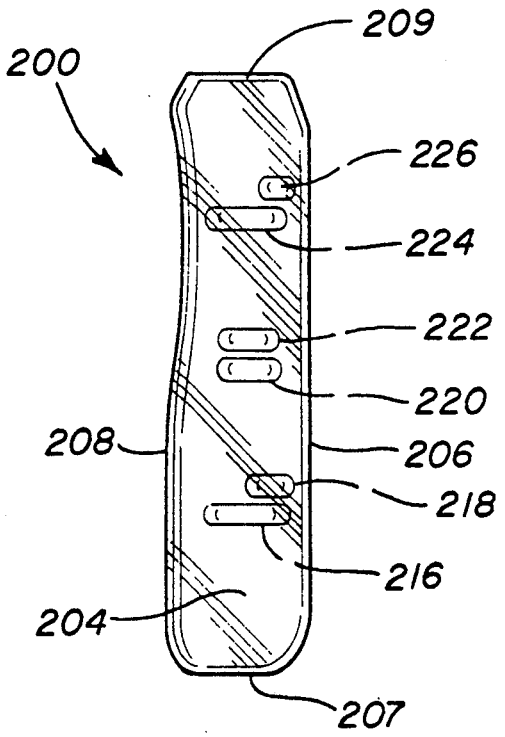
FIG. 11 is a bottom plan view of the medial motion control cushioning element of this invention.
Figure 12:
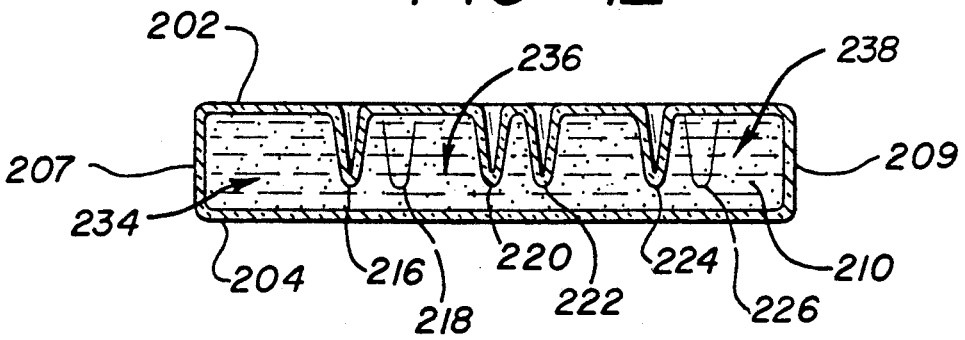
FIG. 12 is a longitudinal cross-sectional view of the medial motion control cushioning element of this invention taken along line 12—12 of FIG. 10.
Figure 13:
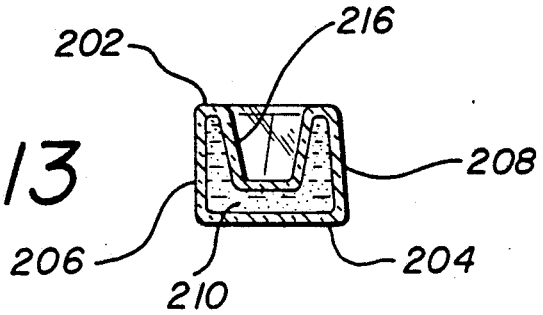
FIG. 13 is a transverse cross-sectional view of the medial motion control cushioning element of this invention taken along line 13—13 of FIG. 10.
Figure 16:
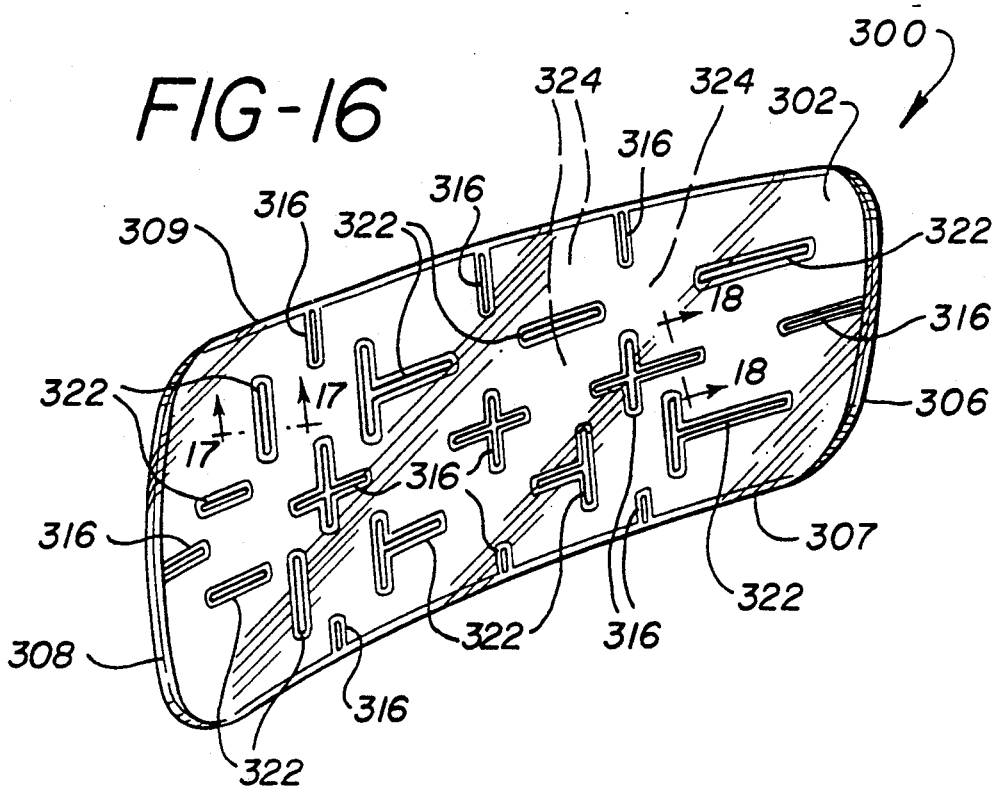
FIG. 16 is a top plan view of the forefoot cushioning element of this invention.

Referring to FIG. 2, midsole 30, generally formed of a foam material, has proximal end 32, distal end 34, top surface 46, bottom surface 48 and a raised lip 52. Referring to FIGS. 2, 4 and 5, the heel strike cushioning element 100 comprises a chamber having a top surface 102, a bottom surface 104, an inner wall 106 and an outer lateral wall 108. Referring to FIGS. 2, 10 and 11, the medial motion control cushioning element 200 comprises a chamber having a top surface 202, bottom surface 204, proximal wall 207, distal wall 209, lateral wall 206 and medial wall 208. Referring to FIGS. 2 and 16 the forefoot cushioning element 300 comprises a chamber having a top surface 302, bottom surface 304, medial wall 306, proximal wall 307, lateral wall 308 and distal wall 309. The walls of the chambers of all of the cushioning elements 100, 200 and 300 are preferably substantially-transparent or alternatively almost translucent. In the preferred embodiment, the walls are comprised of a flexible TPE material (thermoplastic elastomer), e.g. polyurethane. The chambers contain therein a liquid composition 110, 210 and 310. The location of the cushioning elements 100, 200 and 300 within the shoe 20 enables the elements to be viewed from the exterior of the shoe and the transparency of the walls permits the viewing of the coaction of the liquid composition with the interior of the cushioning element.

Still referring to FIG. 2, the foam material of the midsole 30 preferably covers the upper surfaces of the cushioning elements 100, 200, and 200, as well as a major portion of the sides. Rubber outersole 60 has a proximal heel end 62, a distal toe end 64, lateral edge 72 and top surface 66. Bottom 68 is formed into any suitable tread pattern.

After components 100, 200, and 300 are placed within respective cavities 36, 38, and 42 of midsole 30, rubber outersole 60 is bonded with adhesive to the bottom surface 48 of the midsole and the bottom surfaces, 104, 204, and 304 of cushioning elements 100, 200 and 300. Suitable means well known in the art, for example adhesive means, and/or anchoring devices, can be used to adhere or attached to cushioning element 100, 200, and 300 to midsole 30 prior to the bonding of the midsole 30 onto top surface 66 of outersole 60. Upper 22 is bonded onto top surface 46 of midsole 30 along lower edge 24 of upper 22. Again such techniques for attachment are well known in the art.

Figure 9:
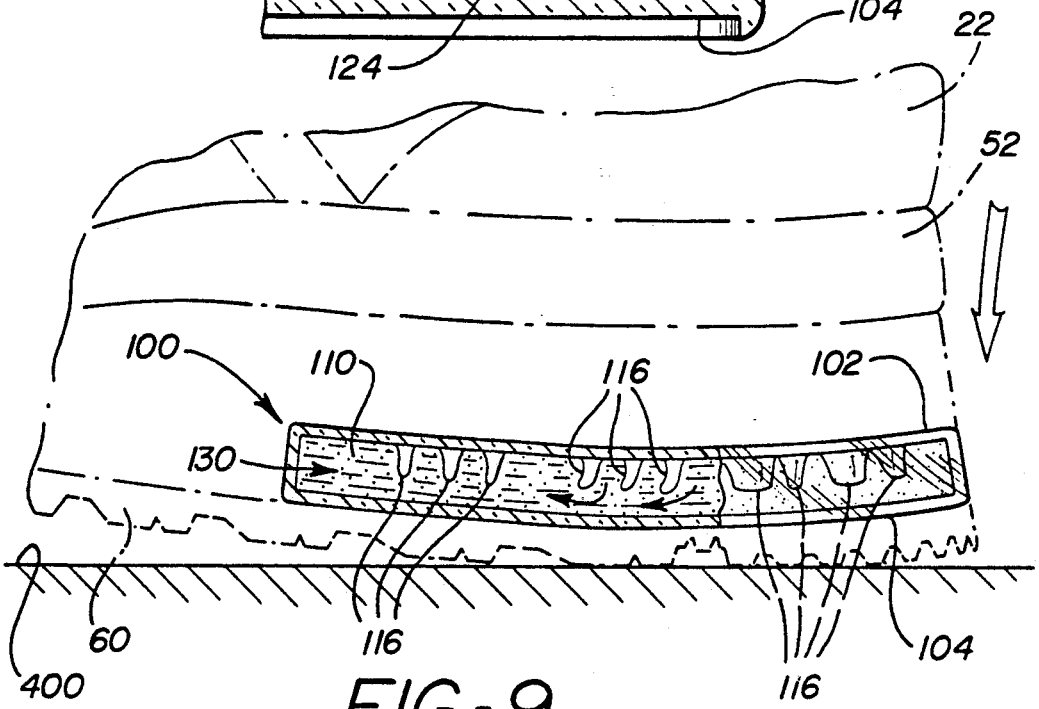
FIG. 9 is a partial longitudinal cross-sectional view of the heel strike cushioning element of this invention taken along line 9—9 of FIG. 4 after initial impact on the element by the heel occurs.

FIG. 4 is a top view of heel strike cushioning element 100. The heel strike cushioning element 10 is positioned within midsole 30 such that its outer lateral wall 108 extends to the peripheral edge of the midsole 30 to provide the wearer with a wide cushioned support base at the heel of the shoe 20. Top surface 102 is in alignment with the heel of the wearer. Heel strike cushioning element 100 comprises a chamber defined by walls which are preferably substantially- transparent or transparent. Heel strike cushioning element 100 is divided into four regions or zones: first zone 124, second zone 126, third zone 128, and fourth zone 130. A series of staggered flexible partitions 116 are disposed in the fourth zone 130 and serve to modulate of direct the transfer or flow of the liquid composition 110, contained within the heel strike cushioning element 100, from one zone to another. See FIG. 9. Some partitions 116 act to direct the flow of the liquid composition 110 while others function as a gating means, i.e., the passage of liquid thereby is permitted only upon the buildup of predetermined liquid pressures.

Liquid composition 110 is preferably comprised of a liquid gel 112 having particulate material 114 therein. Particulate 114 is preferably of a density less than the density of the gel 112 and serves to retard rapid transfer of the liquid composition 110 as it passes about partitions 116 and 118 (See FIGS. 6 and 9). Further, the lower density particulate 114 serves to decrease the weight of the liquid composition 110.

As can be seen in FIGS. 4, 5, 7 and 8, an oval heel cushion 122 overlies first zone 124. Heel cushion 122 is comprised of an annular groove 111 extending from top surface 102 of the heel strike cushioning element 100 towards, but not touching, bottom surface 104. Upon impact, heel cushion 122 absorbs the force of the heel and the liquid composition 110 is gradually urged into adjacent second zone 126. At this point the heel cushion 122 in connection with flexure joint 118 (see FIGS. 4 and 6), becomes a supporting structural element. The overall force generated by the impact of the heel continues urging liquid composition 110 through second zone 126 into third and fourth zones 128 and 130.

Figure 6:
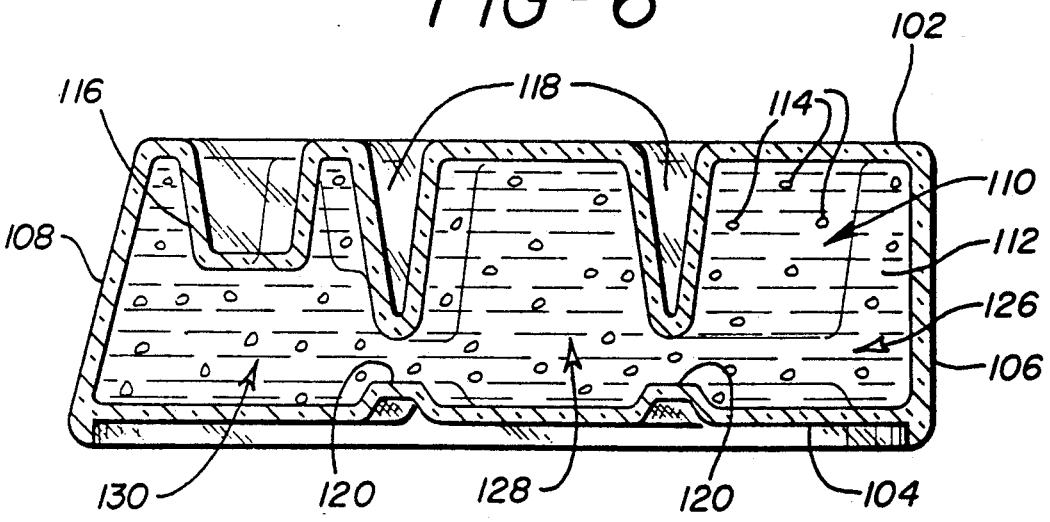
FIG. 6 is a transverse cross-sectional view of the heel strike cushioning element of this invention taken along line 6—6 of FIG. 4.
Figure 7:
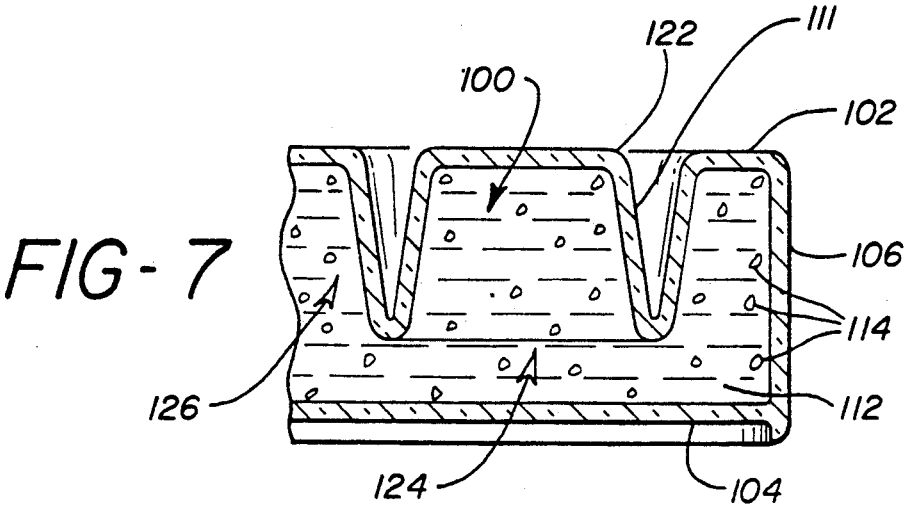
FIG. 7 is a partial cross-sectional view of the heel strike cushioning element taken along line 7—7 of FIG. 4.
Figure 8:
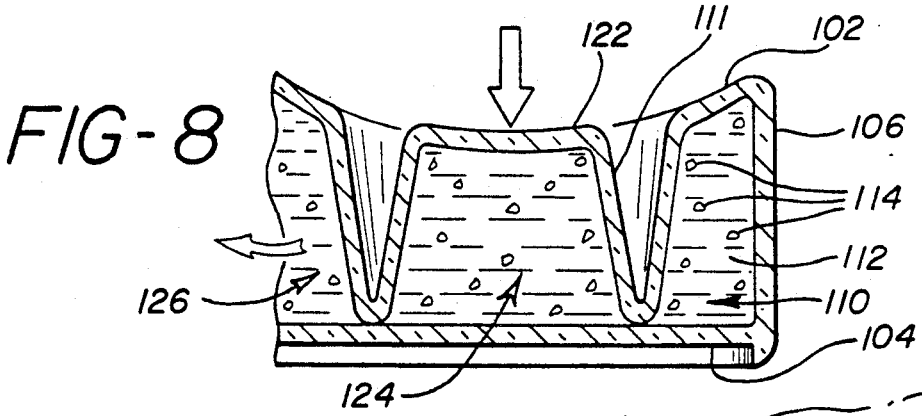
FIG. 8 depicts the heel cushion of FIG. 7 after impact.

Referring to FIGS. 4 and 6, the flexure joint 118 comprises flexible depending partitions. The flexure joint 118 overlies raised ridge channel 120 formed in the bottom 104 of the heel strike cushioning element 100. The raised ridge channel 120 follows the contour of the flexure joint 118. Upon full impact of the heel, the flexure joint 118 is depressed sufficiently such that the downward edge contacts ridge channel 120 and the side walls provide structural stability to heel strike cushioning element 100 (see FIG. 8). Flexure joint 118 serves three primary functions: diversion of liquid composition 110, increased flexibility and structural support. Fourth zone 130 is configured to provide sufficient lateral stability and yet allow for the communication of the liquid composition 110 from one zone of the heel strike cushioning element 100 to another.

During use, localized forces acting in any zone of heel strike cushioning element 100 cause a series of responses in adjacent zones to constantly modulate and adjust the heel strike cushioning element 100 to the heel forces generated by the wearer. See FIG. 9 which depicts the initial impact of the heel of shoe 20 with the ground 400. Instead of a generic shock absorption associated with conventional shock absorption means, the components of this invention offer biomechanically correct placement and self-adjusting shock absorption characteristics throughout the full range of impact. Structural stability is enhanced by virtue of dual purpose partitions and supports 116 and 118 as well as heel cushion 122 and 111 (see FIGS. 7 and 8).

FIGS. 10–15 show medial motion cushioning element 200. Medial motion cushioning element 200 comprises a chamber defined with walls, preferably substantially-transparent or transparent. It further comprises three regions or zones: proximal zone 234, central zone 236 and distal zone 238. Proximal zone 234 is adjacent to and defined by large flexible partition 216 and small flexible partition 218. Central zone 236 extends from partitions 216 and 218 to partitions 224 and 226, which are, respectively, large and small. Disposed within central zone 236 is a pair of flexible partitions 220 and 222. Adjacent distal zone 238, and separating it from central zone 236, is large flexible partition 224 and small flexible partition 226.

The medial motion cushioning element 200 contains a liquid composition 210 comprised, preferably, of a liquid gel 212 and a particulate material 214. The liquid composition 210 is preferably formulated similarly to, and likewise responds similarly to, the liquid composition 110 of heel strike cushioning element 100. It should be noted however that a liquid composition having different characteristics than that used in the heel strike cushioning element 100 may be used. Similarly, the wall structure of each element may be different, e.g. thickness, etc. The partitions within the medial motion cushioning element 20 act similarly to the partitions of the heel strike cushioning element 100 in that they serve to modulate the transfer of the liquid composition 210 from one zone of the medial motion cushioning element 200 to another.

Referring to FIG. 14, after impact of the heel portion of shoe 20 with the ground 400, during the follow through of a stride, slight compression of medial motion cushioning element 200 occurs in proximal zone 234 and urges liquid composition 210 towards central zone 236 and distal Zone 238. FIG. 15 shows the flow path of the gel as it is urged past the flexible partitions (216, 218, 220, 224, and 226), as well as between adjacent zones (234, 236 and 238).

Figure 17:
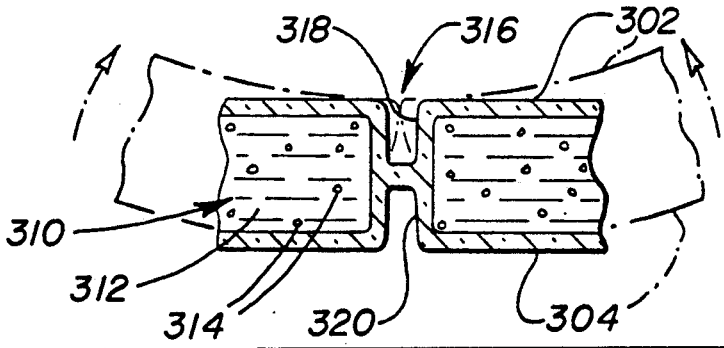
FIG. 17 is a partial cross-sectional view of a contouring ridge taken along line 17—17 of FIG. 16.
Figure 18:
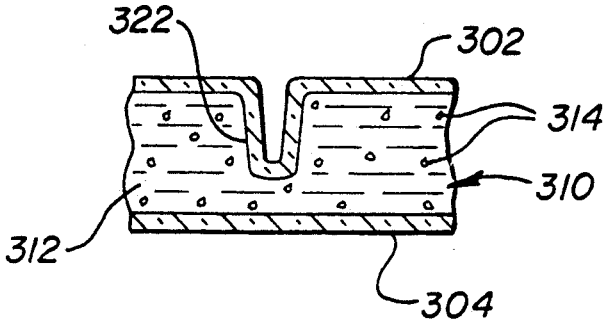
FIG. 18 is a partial cross-sectional view of a partition taken along line 18—18 of FIG. 16.

Forefoot cushioning element 300 is shown in FIGS. 16, 17 and 18. The forefoot Cushioning element 300 comprises a chamber defined by a top surface 302, a bottom surface 304, a medial outer wall 306, a proximal outer wall 307, a lateral outer wall 308 and a distal outer wall 309, the walls, in the preferred embodiment being substantially transparent or transparent. The forefoot cushioning element 300 contains a liquid composition 310 comprised, preferably, of a liquid gel 312 and a particulate material 314. The liquid composition 310 is preferably formulated similar to, and likewise responds similar to, the liquid composition 110 of heel strike cushioning element 100 and the liquid composition 210 of medial motion cushioning element 200, though it may be formulated differently.

Referring to FIGS. 16 and 17, a series of contour ridges, indicated generally at 316, are positioned along the periphery of forefoot cushioning element 300, at various locations therewithin. A contour ridge 316 is formed by adjacent channels 318 and 320 formed at corresponding positions on opposing surfaces 302 and 304 respectively. Contour ridges 316 allow forefoot cushioning element 300 to bend longitudinally and transversely.

Referring to FIGS. 16 and 18, also provided on the forefoot cushioning element 300, is a series of flexible partitions 322 which depend downwardly into the cushioning element from the top surface 302. The flexible positions 322 coact with the contour ridges 316 to define various zones 324 within the forefoot cushioning element 300. The flexible portions 322 act in connection with the contour ridges 316 to modulate the flow of the liquid composition 310 between zones 324 during compression of forefoot cushioning element 300. The flexible partitions 322 also serve as support elements when full compression occurs in a given area. As such, the flexible partitions 322 function similar to the flexure joints 118 of the heel strike cushioning element 100. Upon full compression, the bottoms of the flexible partitions 322 contact the bottom surface 304 of forefoot cushioning element 300 and the sidewalls of the flexible partitions 322 support the top surface 302. Forefoot cushioning element 300 is preferably formed of polyurethane as a single piece.

It can be appreciated by those skilled in the art that with minor design alterations of any or a plurality of the design parameters, the cushioning elements of this invention can be readily adapted for a variety of footwear applications and for achievement of a variety of performance levels for the shoe.

This invention permits the cushioning elements of a shoe to be viewed from the exterior of a shoe. This is accomplished by the exterior of a portion of the cushioning elements 100, 200, and 300 extending to the periphery of the sole of the shoe. Further, because the walls of the cushioning elements 100, 200, and 300 are transparent, the inside of the cushioning element may be viewed. Conventional systems require the use of a window or opening in the midsole of the shoe to allow one to view the interior cushioning action. The cushioning elements 100, 200 and 300 of this invention, however, are preferably designed to be coplaner with the peripheral edge of the midsole thereby allowing full and unrestricted viewing into cushioning elements 1 00, 200 and 300 through the transparent structural sidewalls of the cushioning elements.

The force generated within the gel cushioning elements 100, 200, and 300 cause the deflection of the appropriate partitions and/or flexure joints which act as variable orifice gates which control the flow rate of the liquid composition 110, 210, and 310 as it moves forward in a dynamic "presupportive" manner in preparing the midsole to receive the vectorized forces. Some contour ridges actually separate the composite gel by blocking off the flow, i.e., controlling the flow rate, of the more solid particles of the composite gel system itself. The flexure joints also provide secondary structural support producing an overall support system functionally sensitive to a greater range of forces. The partitions, contour ridges and flexure joints are transparent in the preferred embodiment to increase visibility within the cushioning elements to observe the dynamic composite gel.

The cushioning elements 100, 200 and 300 are filled with a liquid composition 110, 210 and 310, preferably a liquid gel 112, 212 and 312 or a combination of liquid gel 112, 212 and 312, e.g. silicon based, and a particulate material 114, 214 and 314. As a preferred embodiment the gel and particulate includes a particulate material having a density lower than that of the gel to provide a lighter liquid composition than is obtainable with using only a gel composition. Preferably, the particulate material does not absorb the liquid. This results in a retardation of the liquid composition 110, 210 and 310 as it travels, and also produces a ball bearing effect within cushioning elements 110, 210 and 310. Additionally, the combination of gel and particulate, when used in a cushioning element having transparent walls, which extend to the periphery of the midsole, can be viewed from the exterior of the shoe to demonstrate the coaction of the gel and particulate with the unique dynamic structure of the interior of the cushioning element. Note that the gel composition may or may not be pressurized within the chamber of the cushioning elements.

The use of colored liquid compositions within the cushioning elements 100, 200 and 300 can enhance the visualization of the dynamic function. The particulate material 114, 214 and 314 in any or all of the cushioning elements 100, 200 and 300 can be of reflective type material or coating such as glitter, or can be of different color from the liquid composition 110, 210 and 310 itself thereby creating a multicolored effect. Additionally, the liquid composition may be of a iridescence color to enhance the visibility of both the shoe, and the wearer when jogging at night, etc.

The elastomeric foam materials from which the foam and encapsulating member can be made includes the following: polyether urethane; polyester urethane; ethylenevinylacetate/-polyethylene copolymer; polyester elastomer (Hytrel); nitrile rubber; ethylene propylene; polybutadiene; SBR (styrene-butadiene rubber); XNBR (carboxylated nitrile rubber).

The preferred system of this invention comprises a fully blow-molded midsole structure which forms a structural midsole edge and contains the visible dynamic, composite self-compensating, cushioning system of this invention. Upon initial "touchdown contact" of the athletic shoe at the outside lateral edge of the heel aspect, the forces generated cause a series of reactions within the composite gel medium which create unique and controllable flow patterns for different contact points.

While the invention has been described in its preferred embodiments, it is to be understood that the words which have been used are words of description rather than limitation and that changes may be made within the purview of the appended claims without departing from the true scope and spirit of the invention in its broader aspects.

What is claimed is:

1. A cushioning element for a shoe sole comprising:
a chamber having flexible walls including
a top wall,
a bottom wall, and
side walls,
the chamber being filled with a liquid composition,
wherein the chamber includes a plurality of partitions for directing flow from one portion of the chamber to another,
wherein at least one partition is a gating means comprising:
a partition element depending from the top or bottom wall to the opposite wall,
an opening formed between the partition and the opposite wall when the cushion is not compressed,
wherein when the top and bottom walls are compressed together and a differential in liquid pressure is produced, liquid from a chamber portion of higher liquid pressure passes through the opening to a chamber portion of lower liquid pressure, and
wherein when the cushion is sufficiently compressed the opening is closed and the partition element supports the top and bottom walls of the cushion.

2. A cushioning element for a shoe sole comprising:
a chamber having flexible walls including
a top wall,
a bottom wall, and
side walls,
the chamber being filled with a liquid composition,
wherein the liquid composition comprises an amount of a liquid having a liquid density and an amount of particulate having a particulate density, wherein the particulate density is less than the liquid density
wherein the chamber includes a plurality of partitions for directing flow from one portion of the chamber to another,
wherein at least one partition is a gating means comprising:
a partition element depending from the top or bottom wall to the opposite wall,
an opening formed between the partition and the opposite wall when the cushion is not compressed,
wherein when the top and bottom walls are compressed together and a differential in liquid pressure is produced, liquid, including particulate, from a chamber portion of higher liquid pressure passes through the opening to a chamber portion of lower liquid pressure,
wherein when the cushion is sufficiently compressed the opening is closed and the partition element supports the top and bottom walls of the cushion.

3. The cushion of claim 1 or 2, further comprising a flexure joint which is a partition for directing flow of liquid from one portion of the chamber to another portion of the chamber wherein, the flexure joint comprises:

a partition element depending from the top of bottom wall to the opposite wall, wherein an opening is formed between the partition and the opposite wall when the cushion is not compressed, wherein when the top and bottom walls are compressed together and a differential in liquid pressure is produced, liquid, including particulate, from a chamber portion of higher liquid pressure passes through the opening to a chamber portion of lower liquid pressure, wherein when the cushion is sufficiently compressed the opening is closed and the partition element supports the top and bottom walls of the cushion.

4. The cushion of claim 1 or 2, wherein the liquid is a gel.

5. The cushion of claim 1, wherein the chamber is filled with a gel composition comprising an amount of a gel having a gel density and an amount of particulate having a particulate density, wherein the particulate density is less than the liquid density.

6. The cushion of claim 1 or 2, wherein the partition element is flexible.

7. The cushion of claim 1 or 2, wherein the cushion is a forefoot cushioning element having substantially-transparent walls.

8. The cushion of claim 1 or 2, wherein the cushion is a heel strike cushioning element having substantially-transparent walls.

9. A shoe comprising:

a sole portion having a substantially vertical peripheral surface;

a cushioning element comprising:

a chamber having flexible walls including a top wall, a bottom wall, and side walls, at least a portion of the side walls being substantially vertical and constructed to provide vertical support between the top wall and the bottom wall of the chamber, the chamber filled with a liquid composition, the cushioning element overlies the sole portion, and at least a portion of the vertical side walls of the cushioning element which are constructed to provide vertical support substantially extend to a portion of the peripheral surface of the sole to provide cushioning support to the portion of the peripheral surface of the sole, wherein the chamber includes a plurality of partitions for directing flow from one portion of the chamber to another, wherein at least one partition is a gating means comprising:

a partition element depending from the top or bottom wall to the opposite wall, an opening formed between the partition and the opposite wall when the cushion is not compressed, wherein when the top and bottom walls are compressed together and a differential in liquid pressure is produced, liquid from a chamber portion of higher liquid pressure passes through the opening to a chamber portion of lower liquid pressure, and wherein when the cushion is sufficiently compressed the opening is closed and the partition element supports the top and bottom walls of the cushion.

10. A shoe comprising:

a sole portion having a substantially vertical peripheral surface;

a cushioning element comprising:

a chamber having flexible walls including a top wall, a bottom wall, and side walls, at least a portion of the side walls being substantially vertical and constructed to provide vertical support between the top wall and the bottom wall of the chamber, the chamber filled with a liquid composition, the cushioning element overlies the sole portion, and at least a portion of the vertical side walls of the cushioning element which are constructed to provide vertical support substantially extend to a portion of the peripheral surface of the sole to provide cushioning support to the portion of the peripheral surface of the sole and can be viewed from the exterior of the shoe, wherein the chamber includes a plurality of partitions for directing flow from one portion of the chamber to another, wherein at least one partition is a gating means comprising:

a partition element depending from the top or bottom wall to the opposite wall, an opening formed between the partition and the opposite wall when the cushion is not compressed, wherein when the top and bottom walls are compressed together and a differential in liquid pressure is produced, liquid from a chamber portion of higher liquid pressure passes through the opening to a chamber portion of lower liquid pressure, and wherein when the cushion is sufficiently compressed the opening is closed and the partition element supports the top and bottom walls of the cushion.

11. The shoe of claim 10, wherein the portion of the vertical sidewalls which can be viewed from the exterior of the shoe are substantially transparent to permit viewing of the liquid composition in the chamber from the exterior of the shoe through the substantially transparent walls.

12. The shoe of claim 11 wherein the liquid composition comprises an amount of a liquid having a liquid density and an amount of particulate having a particulate density, wherein the particulate density is less than the liquid density.

13. The shoe of claim 9, wherein the partition element is flexible.

14. The shoe of claim 9, wherein the liquid composition comprises an amount of a liquid having a liquid density and an amount of particulate having a particulate density, wherein the particulate density is less than the liquid density.

15. The shoe of claim 9, 10 or 11, wherein the liquid is a gel.

16. The shoe of claim 9, 10 or 11, wherein the cushioning element is a heel strike cushioning element, a medial motion control cushioning element or a forefoot cushioning element.

17. The shoe of claim 9, 10 or 11, wherein the cushioning element is a heel strike cushioning element and wherein the cushioning element has a flexure joint along a portion of the element.

18. The shoe of claim 17, wherein the flexure joint is a partition for directing flow of liquid from one portion of the chamber to another portion of the chamber wherein:

the partition element depends from the top or bottom wall to the opposite wall, an opening formed between the partition and the opposite wall when the cushion is not compressed, wherein when the top and bottom walls are compressed together and a differential in liquid pressure is produced, liquid, including particulate, from a chamber portion of higher liquid pressure passes through the opening to a chamber portion of lower liquid pressure, wherein when the cushion is sufficiently compressed the opening is closed and the partition element supports the top and bottom walls of the cushion.

19. The shoe of claim 9, 10 or 11, wherein the cushioning element is a forefoot cushioning element and has a flexure joint along a portion of the element.

20. The shoe of claim 19, wherein the flexure joint is a partition for directing flow of liquid from one portion of the chamber to another portion of the chamber wherein:

the partition element depends from the top or bottom wall to the opposite wall, an opening formed between the partition and the opposite wall when the cushion is not compressed, wherein when the top and bottom walls are compressed together and a differential in liquid pressure is produced, liquid from a chamber portion of higher liquid pressure passes through the opening to a chamber portion of lower liquid pressure, wherein when the cushion is sufficiently compressed the opening is closed and the partition element supports the top and bottom walls of the cushion.

21. A shoe comprising:

a sole portion having peripheral surfaces:

a cushioning element comprising:

a chamber having flexible walls including a top wall, a bottom wall, and side walls, at least a portion of the side walls being substantially vertical and constructed to provide vertical support between the top wall and the bottom wall of the chamber, the chamber being filled with a liquid composition, wherein the liquid composition comprises an amount of a gel having a gel density and an amount of particulate having a particulate density, wherein the particulate density is less than the gel density, wherein the chamber includes a plurality of partitions for directing flow from one portion of the chamber to another, wherein at least one partition is a gating means comprising:

a partition element depending from the top or bottom wall to the opposite wall, an opening formed between the partition and the opposite wall when the cushion is not compressed, wherein when the top and bottom walls are compressed together and a differential in liquid pressure is produced, liquid, including particulate, from a chamber portion of higher liquid pressure passes through the opening to a chamber portion of lower liquid pressure, and wherein when the cushion is sufficiently compressed the opening is closed and the partition element supports the top and bottom walls of the cushion, the cushioning element overlies the sole portion, and at least a portion of the vertical side walls of the cushioning element which are constructed to provide vertical support substantially extend to a portion of the peripheral surface of the sole to provide cushioning support to the portion of the peripheral surface of the sole, wherein a portion of the vertical sidewalls can be viewed from the exterior of the shoe and are substantially transparent to permit viewing of the liquid composition in the chamber from the exterior of the shoe through the substantially transparent walls.

22. The shoe of claim 21, wherein the cushion includes a flexure joint which is a partition for directing flow of liquid from one portion of the chamber to another portion of the chamber wherein, the flexure joint comprises:

a partition element depending from the top or bottom wall to the opposite wall, wherein an opening is formed between the partition and the opposite wall when the cushion is not compressed, wherein when the top and bottom walls are compressed together and a differential in liquid pressure is produced, liquid, including particulate, from a chamber portion of higher liquid pressure passes through the opening to a chamber portion of lower liquid pressure, wherein when the cushion is sufficiently compressed the opening is closed and the partition element supports the top and bottom walls of the cushion.

23. The shoe of claim 21 or 22, wherein the cushioning element is a heel strike cushioning element.

24. The shoe of claim 21 or 22, wherein the cushioning element is a forefoot cushioning element.

* * * * *